US005467935A

United States Patent [19]

Moody

[11] Patent Number: 5,467,935

[45] Date of Patent: Nov. 21, 1995

[54] APPARATUS FOR SUPPORTING A CORELESS PAPER ROLL AND FOR IMPEDING ROTATION OF THE ROLL DURING PAPER DISPENSING

[75] Inventor: John R. Moody, Antioch, Calif.

[73] Assignee: James River Paper Company, Inc., Richmond, Va.

[21] Appl. No.: 291,418

[22] Filed: Aug. 16, 1994

[51] Int. Cl.[6] ..... B65H 23/08; B65H 16/02

[52] U.S. Cl. ..... 242/422.4; 242/422.5; 242/565; 242/599.1

[58] Field of Search ..... 242/422.4, 422.5, 242/564.1, 564.2, 565, 598.3, 599.1

[56] References Cited

U.S. PATENT DOCUMENTS

| | | | |
|---|---|---|---|
| D. 340,822 | 11/1993 | Morand . | |
| 469,301 | 2/1892 | Morgan | 242/565 |
| 1,299,413 | 4/1919 | Anable | 242/565 |
| 1,391,326 | 9/1921 | Killian | 242/422.5 |
| 1,559,151 | 10/1925 | Brasch | 242/422.4 |
| 1,778,856 | 10/1930 | Hoegger | 242/565 |
| 2,477,362 | 7/1949 | Cavalieri | 242/565 |
| 3,770,221 | 11/1973 | Stern . | |
| 3,848,822 | 11/1974 | Boone . | |
| 3,850,379 | 11/1974 | Stern . | |
| 4,212,434 | 7/1980 | Walker . | |
| 4,239,163 | 12/1980 | Christian . | |
| 4,383,656 | 5/1983 | Campbell . | |
| 4,447,015 | 5/1984 | Peterson | 242/599.1 |
| 4,610,407 | 9/1986 | Stubbmann . | |

FOREIGN PATENT DOCUMENTS

| | | | |
|---|---|---|---|
| 731449 | 6/1955 | United Kingdom | 242/565 |

*Primary Examiner*—John M. Jillions
*Attorney, Agent, or Firm*—Thomas R. Lampe

[57] ABSTRACT

Roll support spindle apparatus for rotatably supporting a coreless paper roll for dispensing. The spindle apparatus includes relatively movable spindle members, at least one of which is locked against rotation to exert a braking force on the coreless paper roll to prevent free-wheeling of the coreless paper roll during unwinding.

7 Claims, 3 Drawing Sheets

APPARATUS FOR SUPPORTING A CORELESS PAPER ROLL AND FOR IMPEDING ROTATION OF THE ROLL DURING PAPER DISPENSING

TECHNICAL FIELD

This invention relates to apparatus for supporting a coreless paper roll. More particularly, the invention is a roll support spindle apparatus to be inserted into and extend through the central aperture of a coreless paper roll for rotatably supporting a coreless paper roll between two mounting elements. The roll support spindle apparatus exerts a braking force on the coreless paper roll to prevent free-wheeling of the coreless paper roll during unwinding thereof. The invention has particular application for use with coreless rolls of toilet tissue.

BACKGROUND ART

It is known in the toilet tissue art to wind the toilet tissue into a coreless roll; that is, the convolutions of the toilet tissue are not wound about a core of paperboard or other material as is the more conventional practice.

It is well known to mount both coreless rolls of toilet tissue and the more conventional rolls of toilet tissue disposed about cores on spindles so that a consumer can rotate the roll to obtain a desired length of toilet tissue, said length being torn off along lines of perforation or, particularly in the case of rolls not having lines of perforation, severed or cut in some manner.

One of the problems encountered in such arrangements is free-wheeling of the coreless paper roll during unwinding thereof while on its associated spindle. In other words, the consumer dispenses the toilet tissue by pulling on the free end thereof. This results in rotation of the toilet tissue roll. Inertial forces tend to result in a continuation of such rotation even after the desired amount of tissue has been unwound from the roll. This results in considerable waste and also can cause contamination of the toilet tissue if the free end thereof is too long and contacts a surrounding surface such as a floor.

A number of brake devices have been devised for preventing free-wheeling or over-running of rolls of toilet paper and the like. However, such mechanisms are essentially designed for use with toilet tissue rolls having cores and are either inapplicable or inappropriate for use with coreless paper rolls. Additionally, many of the prior art devices are characterized by their relative complexity and consequent high expense.

The following United States patents disclose devices believed representative of the current state of the prior art: U.S. Pat. No. 3,770,221, issued Nov. 6, 1973, U.S. Pat. No. Des. 340,822, issued Nov. 2, 1993, U.S. Pat. No. 3,848,822, issued Nov. 19, 1974, U.S. Pat. No. 3,850,379, issued Nov. 26, 1974, U.S. Pat. No. 4,212,434, issued Jul. 15, 1980, U.S. Pat. No. 4,239,163, issued Dec. 16, 1980, U.S. Pat. No. 4,383,656, issued May 17, 1983, and U.S. Pat. No. 4,610,407, issued Sep. 9, 1986.

DISCLOSURE OF INVENTION

The present invention relates to a roll support spindle apparatus which inexpensively, efficiently, and effectively serves to support a coreless paper roll for dispensing and exerts a braking force on the coreless paper roll to prevent free-wheeling thereof during unwinding. Furthermore, the roll support spindle apparatus is so constructed as to resist accidental dislodgement of the roll support spindle apparatus and coreless paper roll supported thereby from cooperating mounting elements.

The roll support spindle apparatus of the present invention is to be inserted into and extend through the central aperture of a coreless paper roll defined by the innermost convolution of the coreless paper roll. The coreless paper roll has a uniform width.

The roll support spindle apparatus is for rotatable supporting the coreless paper roll between two mounting elements having indents and for exerting a braking force on the coreless paper roll to prevent free-wheeling of the coreless paper roll during unwinding thereof.

The roll support spindle apparatus includes an inner spindle member having an inner spindle end. The inner spindle end includes a projection for insertion into a mounting element indent.

An outer spindle member defines an outer spindle member interior and has an outer spindle open end and an outer spindle closed end. The outer spindle closed end includes a projection for insertion into a mounting element indent, the inner spindle member being telescopically received within the outer spindle member interior with the projections spaced from one another.

Spring means disposed within the outer spindle interior biases the inner spindle member and the outer spindle member away from each other.

Spindle stop means is affixed to the outer spindle member closely adjacent to the projection of the outer spindle closed end for engagement with a mounting element receiving the projection of the outer spindle closed end to engage the mounting element receiving the projection of the outer spindle closed end during unwinding of a coreless paper roll supported by the roll support spindle apparatus to prevent rotation of the outer spindle member whereby the outer spindle member will exert a braking force on the coreless paper roll to impede rotation of the coreless paper roll during dispensing of paper therefrom.

Other features, advantages, and objects of the present invention will become apparent with reference to the following description and accompanying drawings.

MODES FOR CARRYING OUT THE INVENTION

Figure 2:
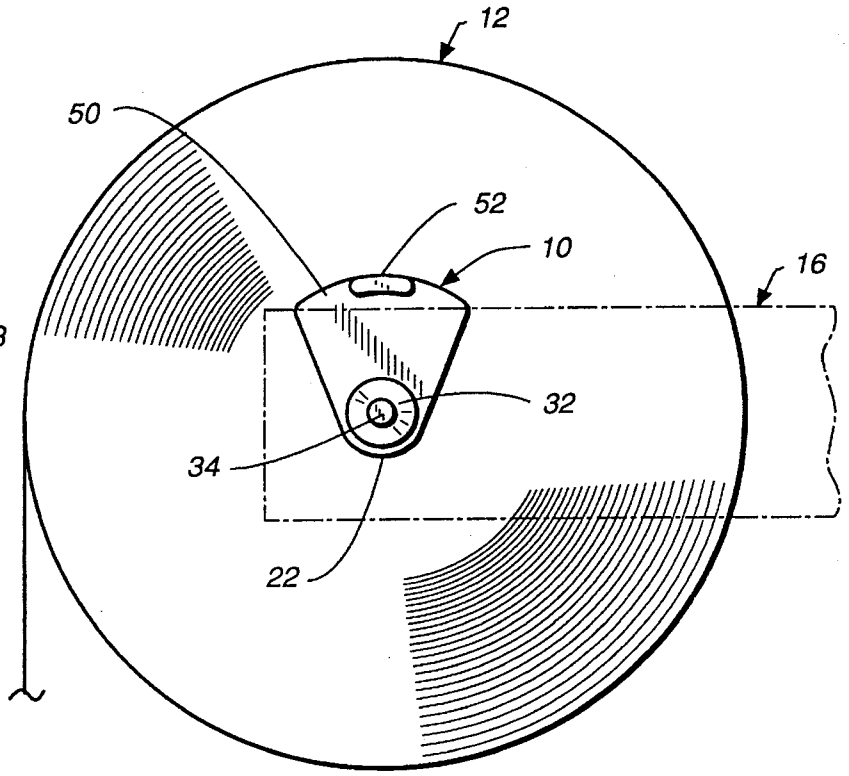
FIG. 2 is an end view of the apparatus and roll with a mounting element illustrated in phantom.
Figure 1:
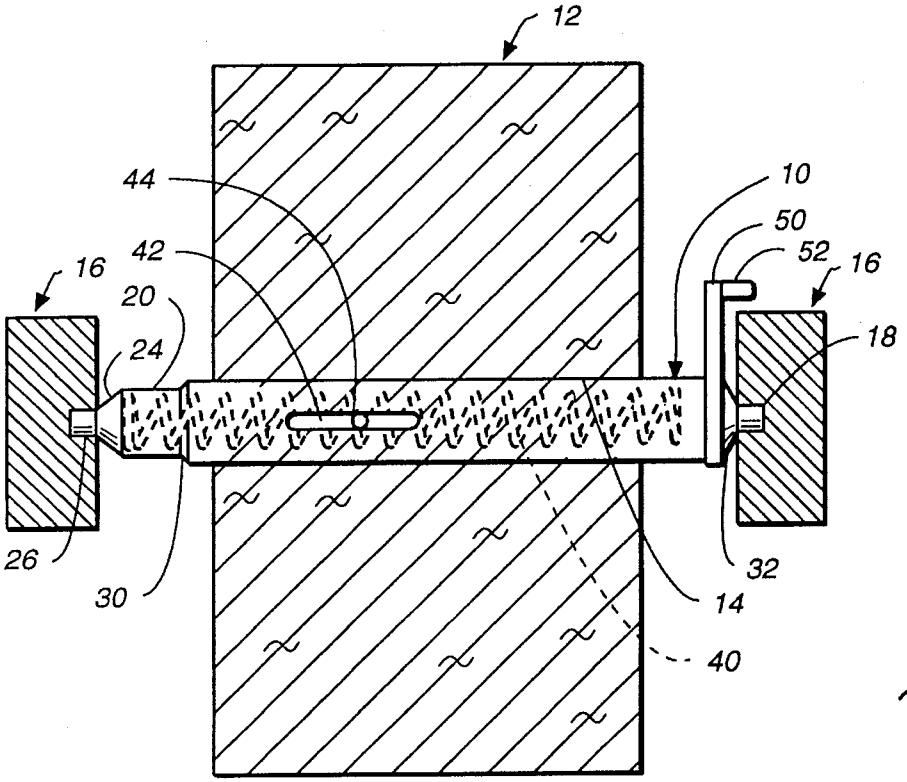
FIG. 1 is a front, elevation view of roll support spindle apparatus constructed in accordance with the teachings of the present invention supporting a coreless roll of paper tissue between mounting elements, the roll and mounting elements being depicted in cross section and an interior spring of the spindle apparatus shown in dash lines.
Figure 3:
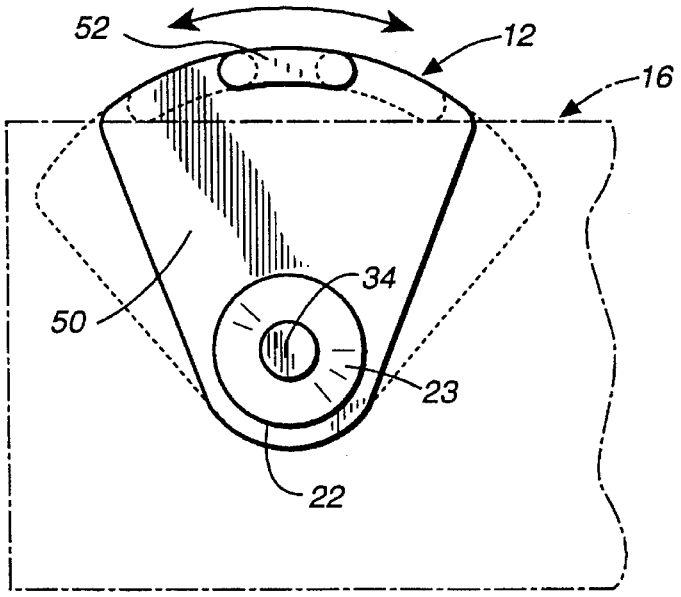
FIG. 3 is an enlarged side view illustrating selected components of the apparatus and illustrating alternate positions assumed thereby.

Referring now to FIGS. 1–3 of the drawings, apparatus constructed in accordance with the teachings of the present invention is designated by reference numeral 10. Apparatus 10 is in the form of a spindle for insertion into a coreless paper roll 12 (FIGS. 1 and 2).

More particularly, the roll support spindle apparatus 10 is inserted into and extends through the central aperture 14 of the roll which is defined by the innermost convolution of the roll. The coreless paper roll has a uniform width.

The roll support spindle apparatus 10 is in relatively tight engagement with the roll and is for rotatably supporting the coreless paper roll between two mounting elements 16 having indents 18.

Apparatus 10 includes an inner spindle member 20 and an outer spindle member 22.

Inner spindle member 20 has a closed end 24 which is tapered and includes a boss or projection 26. Projection 26 is rotatably seated in an indent 18 of one of the mounting elements.

Outer spindle member 22 defines an interior and has an open end 30 which is tapered or chamfered and communicates with the interior. Inner spindle member 20 is telescopically received within the outer spindle member interior.

At the end of the outer spindle member remote from the inner spindle member, outer spindle member 22 has a closed end 32 having a projection 34 identical to projection 36 of the inner spindle member. Projections 26, 34 are freely rotatable within their respective indents.

A coil compression spring 40 (shown in dash lines in FIG. 1) is located within the interior of the outer spindle member 22 and exerts a continuous biasing force on the spindle members 20, 22 urging them apart. A slot 42 is formed in the outer spindle member which slidably receives a pin 44 connected to and projecting from inner spindle member 20. Thus, the spindle members are free to move relative to one another in an axial direction to a certain extent determined by the length of the slot but not in a rotational direction.

The apparatus 10 includes means for preventing rotation of the outer spindle member (as well as of the inner spindle member due to slot and pin arrangement 42, 44) whereby the outer spindle member will exert a braking force on the roll 12 to impede or retard rotation of the roll during dispensing of paper therefrom. More particularly, a first stop element in the form of a plate 50 projects laterally outwardly from the outer spindle member closely adjacent to the projection 18 thereof. Plate 50 is integral with the outer spindle member and may, for example, be integrally molded therewith from plastic.

A second stop element in the form of a tab 52 is integrally formed with the first stop element and the outer spindle member and projects outwardly from the first stop element in a direction away from the coreless paper roll.

It will be noted that tab 52 extends over the top of mounting element 16 disposed at the outer spindle member end of apparatus 10.

Unwinding of the roll 12 by a consumer is accomplished in the usual manner by grasping the free end or tail (not shown) of the roll and pulling it to unwind the tissue material and rotate the roll. Since the spindle apparatus 10 is snugly received within the central aperture of the roll the apparatus 10 will also tend to rotate. However, when this occurs, the tab 52 will almost immediately engage the top of its associated mounting element 16 and terminate rotation of the apparatus. When the rotation of the spindle member stops, a drag is created on the roll of tissue during the unwinding process so that free-wheeling of the roll does not occur as unwinding continues. FIG. 3 illustrates the limited degree of movement of tab 52 available.

In the event tissue roll 12 is bumped during usage it will slide axially on the apparatus 10. The roll will not be separated from the mounting elements 16. This is due to the fact that the spindle stop is located at the outer end of the outer spindle member and by providing a spring 40 of sufficient strength to firmly restrict compression of the inner spindle member inwardly relative to the outer spindle member. The inner surface of plate 50 acts as an abutment surface which will be engaged by an axially sliding roll to limit such axial movement.

After a roll 12 is depleted the apparatus 10 is removed from mounting elements 16 by manually compressing together the inner and outer spindle members to withdraw the projections from their respective recesses. The apparatus is then inserted into the central aperture of a new coreless paper roll and pushed therethrough, the projection 18 of the inner spindle member of course being the initial structure of the apparatus forced through the roll. The tapered closed end of the inner spindle member and the tapered open outer end of the outer spindle member facilitate movement of the apparatus through the roll.

Figure 6:
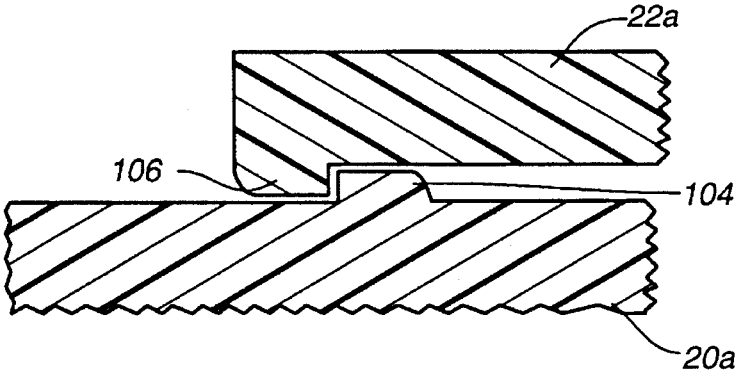
FIG. 6 is a greatly enlarged cross-sectional view showing a detail of that portion of the alternate embodiment delineated by double headed arrow 6—6 in FIG. 5.
Figure 7:
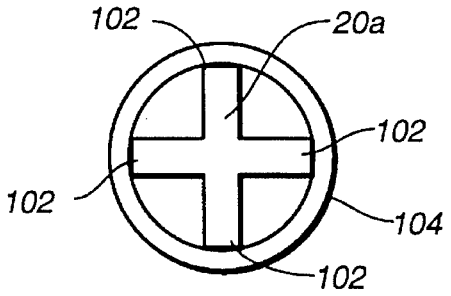
FIG. 7 is a greatly enlarged end view in the direction of double headed arrow 7—7 in FIG. 4.
Figure 4:
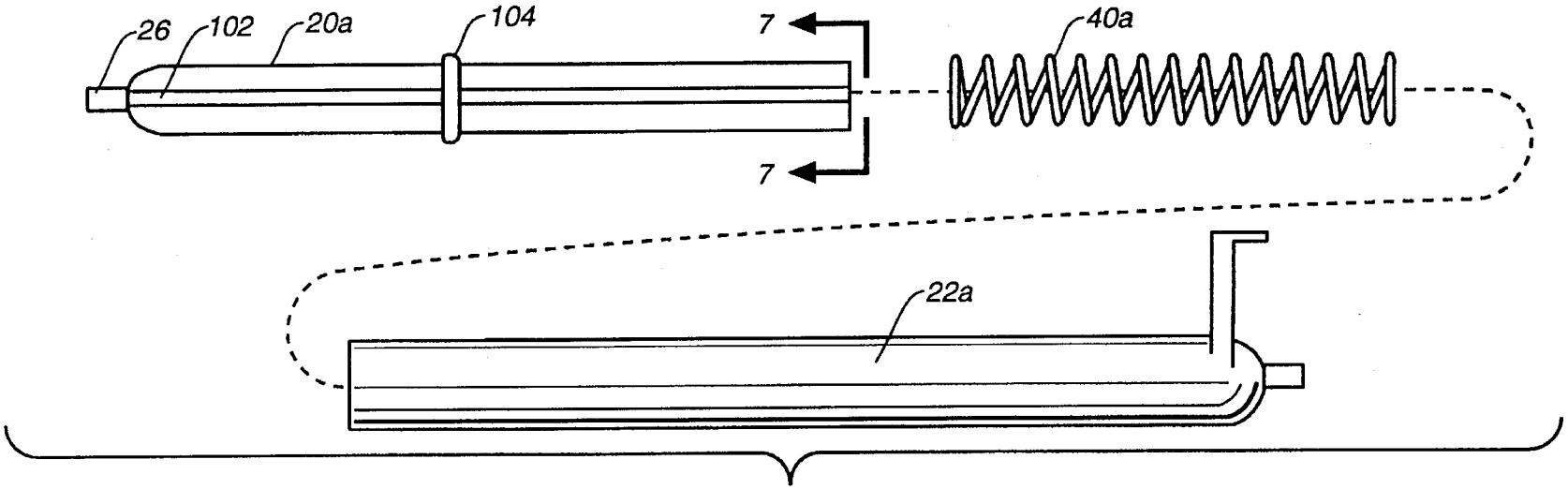
FIG. 4 is an exploded view of an alternative embodiment of the apparatus.
Figure 5:
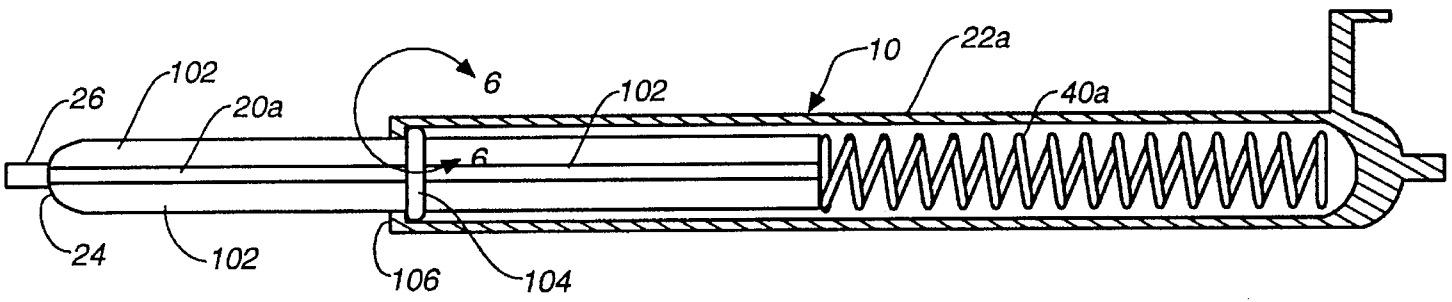
FIG. 5 is an enlarged side view of the alternative embodiment of the apparatus with a portion of the apparatus in cross-section.

FIGS. 4–6 illustrate an alternative embodiment of the invention wherein inner spindle member **20*a* has ribs 102 which give the inner spindle member 20*a* a cruciform cross-section. A ring 104** is fixed in position between the ends of the inner spindle member.

The cylindrical side wall at the open end of outer spindle member **22*a* is turned inwardly to form an abutment 106. This abutment is engaged by ring 104 under the urging of coil compression spring 40*a* so that the inner nozzle spindle member will be retained in the outer spindle member. In this embodiment of the invention, the spring bears against the end of inner nozzle spindle member 20*a***. Engagement between the coreless roll and the outer spindle member will resist rotation of the roll.

I claim:

1. Roll support spindle apparatus to be inserted into and extend through the central aperture of a coreless paper roll defined by the innermost convolution of the coreless paper roll, the coreless paper roll having a uniform width, and said roll support spindle apparatus for rotatably supporting the coreless paper roll between two mounting elements having indents, for exerting a braking force on the coreless paper roll to prevent free-wheeling of the coreless paper roll during unwinding thereof, and for resisting inadvertent dislodgement of the roll support spindle apparatus and the coreless paper roll from the mounting elements due to end-wise force exerted on the coreless paper roll while the coreless paper roll is supported in the roll support spindle apparatus, said roll support spindle apparatus comprising, in combination:

a double-ended inner spindle member having a first inner spindle end and a second inner spindle end, said first inner spindle end including a projection for insertion into a first mounting element indent;

an outer spindle member defining an outer spindle member interior and having an outer spindle open end and an outer spindle closed end, said outer spindle closed end including a projection for insertion into a second mounting element indent, said inner spindle member being telescopically received within the outer spindle member interior with the second inner spindle end located within the outer spindle member interior and with the projections spaced from one another;

spring means within the outer spindle interior continuously biasing said inner spindle member and said outer spindle member away from each other; and spindle stop means affixed to said outer spindle member at the outer spindle closed end closely adjacent to the projection of the outer spindle closed end for engagement with a mounting element receiving the projection of the outer spindle closed end to engage the mounting element receiving the projection of the outer spindle closed end during unwinding of a coreless paper roll supported by the roll support spindle apparatus to prevent rotation of the outer spindle member whereby said outer spindle member will exert a frictional braking force on the coreless paper roll to impede rotation of the coreless paper roll during dispensing of paper therefrom, said spindle stop means including a first stop element projecting laterally outwardly from said outer spindle member at the outer spindle closed end closely adjacent to the projection of the outer spindle closed end and a second stop element affixed to said first stop element and projecting laterally outwardly from said first stop element in a direction away from the coreless paper roll, said second stop element engaging the mounting element receiving the projection of the outer spindle closed end upon rotation of the coreless paper roll to prevent rotation of said outer spindle member, and said first stop element including an abutment surface for engaging the coreless paper roll upon sliding movement of the coreless paper roll axially along the outer spindle member in the direction of the spindle stop means and said spring means within the outer spindle interior having sufficient biasing strength to prevent telescopic movement of said inner spindle member relative to said outer spindle member due to end-wise force exerted on the coreless paper roll in the direction of the first inner spindle end to prevent dislodgement of the roll support spindle apparatus from the mounting elements.

2. The roll support spindle apparatus according to claim 1 wherein said outer spindle member has a length exceeding the width of a coreless paper roll whereby said outer spindle member projects beyond both ends of a coreless paper roll.

3. The roll support spindle apparatus according to claim 2 wherein the outer spindle open end and the first inner spindle end are tapered to facilitate passage of the outer spindle member and the inner spindle member through the central aperture of a coreless paper roll when said roll support apparatus is inserted into the central aperture.

4. The roll support apparatus according to claim 1 wherein said first stop member comprises a plate integrally connected to the outer spindle member.

5. The roll support apparatus according to claim 1 wherein said second stop element is a tab integrally connected to said first stop element.

6. The roll support apparatus according to claim 1 wherein said outer spindle member, said first stop element and said second stop element are integrally connected.

7. The roll spindle apparatus according to claim 1 additionally comprising means for locking said spindle members against relative rotation.

* * * * *